US008079937B2

(12) United States Patent
Bedell et al.

(10) Patent No.: US 8,079,937 B2
(45) Date of Patent: Dec. 20, 2011

(54) EXERCISE APPARATUS WITH AUTOMATICALLY ADJUSTABLE FOOT MOTION

(76) Inventors: Daniel J Bedell, Beaverton, OR (US); Joseph D Maresh, West Linn, OR (US); Kenneth W Stearns, Houston, TX (US)

( * ) Notice: Subject to any disclaimer, the term of this patent is extended or adjusted under 35 U.S.C. 154(b) by 112 days.

(21) Appl. No.: 12/411,257

(22) Filed: Mar. 25, 2009

(65) Prior Publication Data

US 2010/0248899 A1 Sep. 30, 2010

(51) Int. Cl.
*A63B 24/00* (2006.01)

(52) U.S. Cl. ..... 482/4; 482/1

(58) Field of Classification Search ..... 482/1, 4, 482/51, 52, 53, 62, 70
See application file for complete search history.

(56) References Cited

U.S. PATENT DOCUMENTS

| | | | | |
|---|---|---|---|---|
| 6,063,009 | A | 5/2000 | Stearns et al. | |
| 6,648,800 | B2 | 11/2003 | Stearns et al. | |
| 6,926,646 | B1 * | 8/2005 | Nguyen | 482/71 |
| 6,949,053 | B1 | 9/2005 | Stearns et al. | |
| 7,025,710 | B2 | 4/2006 | Corbalis et al. | |
| 7,097,591 | B2 | 8/2006 | Moon | |
| 7,141,004 | B2 | 11/2006 | Stearns et al. | |
| 7,226,392 | B2 | 6/2007 | Hong | |
| 7,267,637 | B2 | 9/2007 | Mercado et al. | |
| RE39,904 | E | 10/2007 | Lee | |
| 7,361,122 | B2 | 4/2008 | Porth | |
| 7,540,827 | B1 | 6/2009 | Stearns et al. | |
| 7,758,469 | B2 * | 7/2010 | Dyer et al. | 482/4 |
| 2005/0209056 | A1 * | 9/2005 | Daly et al. | 482/52 |
| 2006/0003872 | A1 * | 1/2006 | Chiles et al. | 482/57 |
| 2006/0094569 | A1 * | 5/2006 | Day | 482/57 |
| 2007/0087906 | A1 | 4/2007 | Rodgers, Jr. | |
| 2007/0087907 | A1 | 4/2007 | Rodgers, Jr. | |

* cited by examiner

*Primary Examiner* — Loan Thanh
*Assistant Examiner* — Shila Jalalzadeh Abyane
(74) *Attorney, Agent, or Firm* — Chernoff, Vilhauer, McClung & Stenzel

(57) ABSTRACT

An elliptical exercise apparatus includes a frame, a pair of footpads, and a linkage coupling the footpads to the frame and for guiding the footpads in closed paths when a user's feet apply forces to the footpads. The linkage, which includes a rotatable member having an angular position indicative of the positions of the footpads within their closed paths, responds to input control signals by adjusting length and height dimensions of the closed paths. A control system senses the angular position of the rotatable member, senses the forces the user applies to the footpads, and generates the control signals to increase or decrease the path dimensions when it senses particular combinations of angular position and user forces, thereby permitting the user to control the path dimensions by controlling the forces applied to the footpads.

34 Claims, 9 Drawing Sheets

EXERCISE APPARATUS WITH AUTOMATICALLY ADJUSTABLE FOOT MOTION

BACKGROUND OF THE INVENTION

1. Field of the Invention

The present invention relates to exercise apparatus, and more specifically to an exercise apparatus that guides a user's feet through automatically adjustable paths of motion.

2. Description of Related Art

Running on treadmills remains a popular form of indoor aerobic exercise even though it can lead to injuries. A runner hops from foot-to-foot, stressing his or her lower extremities with repetitive impact forces of each footfall that can eventually injure joints and tendons. Running the equivalent of only ten miles per day on a treadmill can expose each leg to 200,000 impacts per year. Many other kinds of exercise apparatus, including stationary bicycles, steppers, climbers, gliders and skiers, provide indoor aerobic exercise that allow a user's feet to follow a closed path without the impact stress associated with treadmills, however despite the advantages of these apparatus, running on treadmills remains popular. Since people are structurally better adapted to run rather than to pedal, climb steps, glide or ski, they often feel more comfortable running.

Elliptical exercise apparatus include foot support or pedals following closed paths designed to mimic the non-circular paths a user's feet trace out when running on a treadmill, but since the user's feet do not leave the foot supports, the user can engage in a running style of exercise without experiencing the repetitive impacts associated with running on a treadmill. Since the user's feet follow paths that are neither linear nor circular, they are commonly called "elliptical" paths to distinguish them over the circular closed paths provided stationary bicycle apparatus and the linear or arcuate closed paths associated with steppers and skier, gliders and climbers, even though an elliptical exercise apparatus normally does not provide a truly elliptical foot path.

A typical elliptical exercise apparatus includes a crank moving in a circular motion and a linkage mechanism coupling the crank to its foot supports for converting the circular motion of the crank into the "elliptical" motion of the foot supports. The linkage also includes a resistance device such as a regenerative or eddy current brake coupled to the crank for providing an adjustable resistance to the foot motion for controlling the amount of work the user must expend to move the foot supports. Examples of elliptical exercise apparatus are disclosed in U.S. Pat. No. 4,185,622 to Swenson; U.S. Pat. No. 5,278,529 to Eschenbach, U.S. Pat. No. 5,383,829 to Miller; U.S. Pat. No. 5,540,637 to Rodgers, Jr.; U.S. Pat. No. 6,196,948 to Steams et al.; and U.S. Pat. No. 6,468,184 to Lee, all of which are incorporated herein by reference.

The height and length of a runner's stride varies depending on running speed, on the terrain and on the runner's preferences. While early elliptical exercise apparatus designs allowed a user to engage in a running style of motion while avoiding the impact stress associated with treadmills, the shape of the path the user's foot followed was fixed and the user was not able to adjust either the height or length of stride. Later elliptical exercise apparatus designs allowed a user to adjust stride length. For example U.S. Pat. No. 5,893,820 issued Apr. 13, 1999 to Maresh et al. describes an elliptical apparatus allowing a user to adjust the shape of an elliptical footpath by manually changing the linkage between the crank and the foot supports. U.S. Pat. No. 5,919,118 issued Jul. 6, 1999 to Steams et al. teaches to incorporate a linear actuator into the linkage that can expand or contract to change the shape of the linkage in response to a signal controlled by a user-operable button on a control panel, thereby to change stride length. Although these apparatuses allow a user to adjust stride length, they required the user to stop the apparatus and manually alter the linkage, or to operate a control knob or button while exercising, either of which is inconvenient.

Still later designed elliptical exercise apparatuses automatically adjust stride length or height. U.S. Pat. No. 6,206,804 issued Mar. 27, 2001 to Maresh describes an elliptical exercise including dampers or springs in the linkage assembly defining the user's footpath that automatically vary the path shape in response to forces applied by the user's foot. U.S. patent application 20050181911, filed Aug. 18, 2005 by Porth teaches an elliptical exercise apparatus that senses the speed at which the crank rotates in which the crank rotates and adjusts an actuator in the linkage so that both stride length and height change with speed and pedaling direction. While the apparatus automatically adjusts stride length or height, there is no assurance that stride length or height that is adjusted as a function of speed or direction will match the user's desired stride length or height.

SUMMARY OF THE INVENTION

An elliptical exercise apparatus in accordance with the invention includes frame, a pair of footpads for supporting the user's feet, and a linkage coupling the footpads to the frame for guiding the footpads in a closed paths when the user's feet apply forces to the footpads. The linkage includes actuators that respond to control signals by adjusting length and height dimensions of the closed paths. The linkage also includes a rotatable member having an angular position that is indicative of the positions of the footpads within their closed paths.

The exercise apparatus further includes a control system that senses the angular position of the rotatable member and, for each footpad, senses the forces applied to the footpad and generates the control signals for controlling the length and height dimensions of the closed path as functions of the sensed angular position and forces. The control system increases or decreases the length and height dimensions of the closed path of each footpad when the user-applied force on the footpad is outside a particular magnitude range while the angular position of the rotatable member is within a particular angular position range. The exercise apparatus thus enables the user to independently control stride height and length of each footpad by controlling magnitudes of the forces the user applies to each footpad as it passes through a particular section of its closed path.

In one embodiment of the invention, the control system includes strain gauges attached to the footpads that sense user applied forces. In another embodiment of the invention, the controller determines user applied forces as functions of the acceleration of the rotatable member.

The claims appended to this specification particularly point out and distinctly claim the subject matter of the invention. However those skilled in the art will best understand both the organization and method of operation of what the applicants consider to be the best modes of practicing the invention by reading the remaining portions of the specification in view of the accompanying drawings, wherein like reference characters refer to like element.

DETAILED DESCRIPTION OF THE PREFERRED EMBODIMENT

Figure 1:
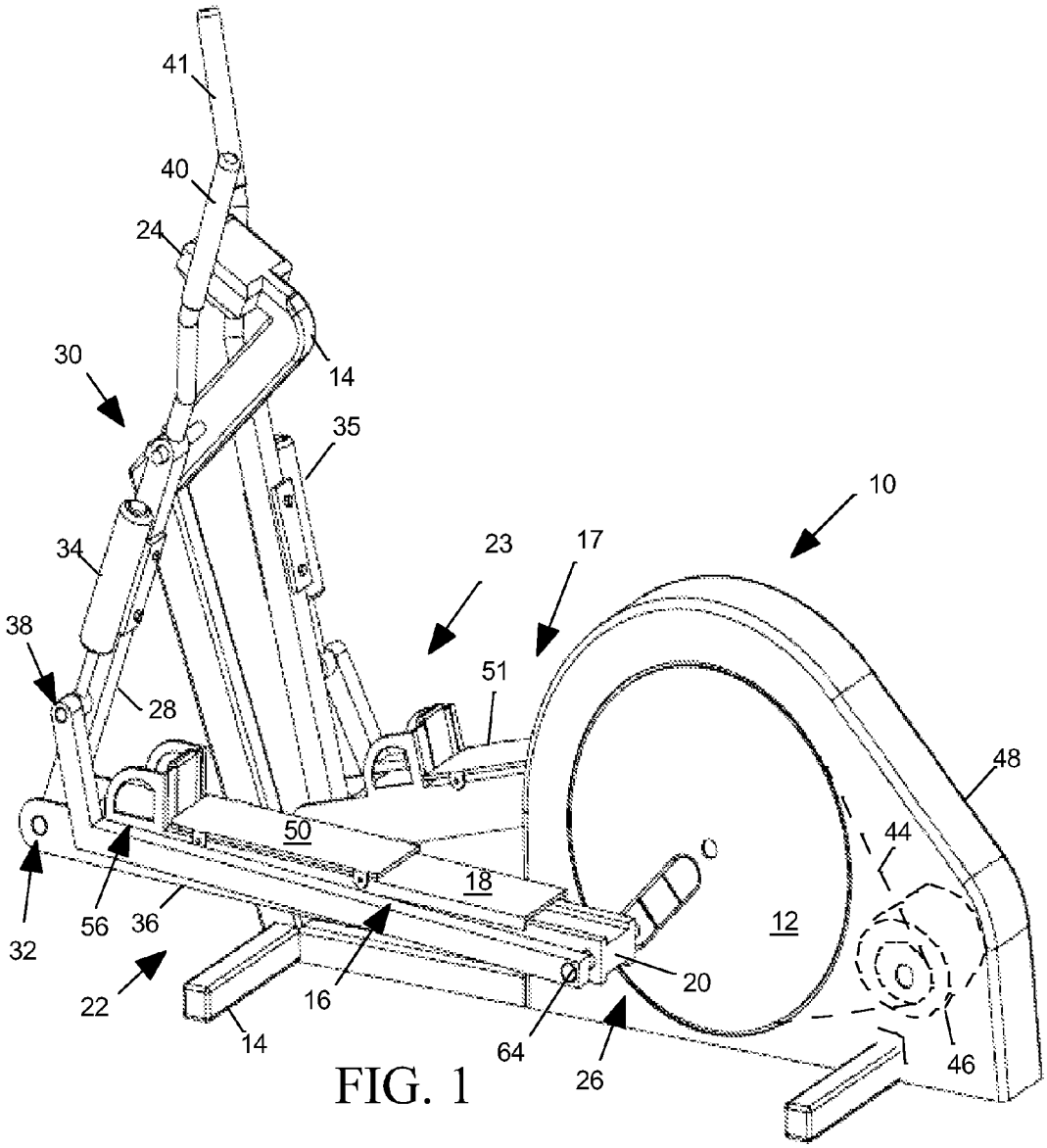
FIG. 1 is a perspective view an exercise apparatus constructed according to the principles of the present invention.

The present invention may be implemented in connection with exercise apparatus having a frame, user-operable footpads and a linkage for coupling the footpads to the frame and for guiding the footpads in closed paths. The invention relates in particular to a method for automatically responding to user forces applied to the footpads by adjusting one or more dimensions of the closed path each foot support follows. Although the invention is illustrated below as being used to control path dimensions in an elliptical exercise machine, the invention may be used to control path dimensions in other types of exercise machines having adjustable path dimensions. Although there are many possible modes of practicing the invention defined by the claims appended to this specification, the following specification and drawings describe in detail only preferred embodiments of practicing the invention. Since not all implementation details described below are necessary to practice the invention as recited in the claims, it is intended that the invention be limited only by the claims.

Mechanical System

FIGS. 1-5 depict an elliptical exercise apparatus 10 in accordance with the invention including a frame 14, a left footpad 50 and a right footpad 51 for supporting a user's left and right feet. Left and right linkage assemblies 22 and 23 for a linkage for coupling the left and right footpads 50 and 51 to frame 14 and for guiding the footpads in closed paths when the user's feet apply forces to the footpads. As discussed below, each linkage assembly 22 and 23 includes actuators that respond to control signals by adjusting length and height dimensions of the closed path its corresponding footpad follows. Each linkage assembly also includes a rotatable member, suitably a crank member 12 rotatably mounted on a frame 14, having an angular position that is indicative of the positions of the footpads within their closed paths. A control system, including a control panel 24 mounted on frame 14, senses the angular position of the rotatable member and, for each footpad, senses the forces applied to the footpad and generates the control signals for controlling the length and/or height dimensions of the closed path as functions of the sensed angular position and forces. The control system increases or decreases the length and height dimensions of the closed path of a footpad when the user-applied force on the footpad is outside a particular magnitude range while the angular position of the rotatable member is within a particular angular position range. Exercise apparatus 10 thus allows the user to control stride height and length by controlling magnitudes of the forces the user applies to the footpads as they pass though particular sections of their closed paths.

Left linkage assembly 22 also includes a telescoping left foot member 16 having an upper channel member 18 supporting left footpad 50 and slidably engaging a lower channel member 20. Left linkage assembly 22 further includes an adjustable length crank assembly 26 pivotally coupling lower channel member 20 to crank member 12, a left rocker arm 28 pivotally coupled to frame 14 through a bearing pin 30 and pivotally coupled to upper channel member 18 through a bearing pin 32, a left linear actuator 34 attached to rocker arm 28, and a left drawbar 36 pivotally coupled to crank member 12 and lower channel member 20 through bearing pin 26 and pivotally coupled to actuator 34 through a bearing pin 38. An upper end of rocker arm 28 forms a handlebar 40.

Right linkage assembly 23 is generally similar to left linkage assembly 22 and includes a telescoping right foot member 17 for supporting the right footpad 51, a right side actuator 35 similar to left side actuator 34.

In addition to the right and left linkage assemblies 22 and 23, the linkage also includes a regenerative brake 46 mounted inside frame housing 48 and a crank member 12 connected through a belt 44 to the regenerative brake's rotor that rotates with crank member 12. Brake 46 provides an amount of resistance to crank member rotation that is adjusted by a control signal from control panel 24.

Figure 2A:
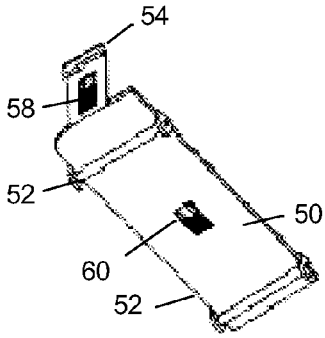
FIGS. 2A and 2B are perspective views of a footpad of the exercise apparatus of FIG. 2.
Figure 2B:
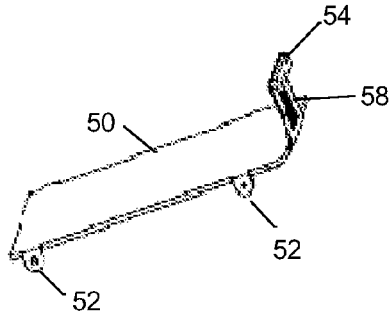
Figure 3:
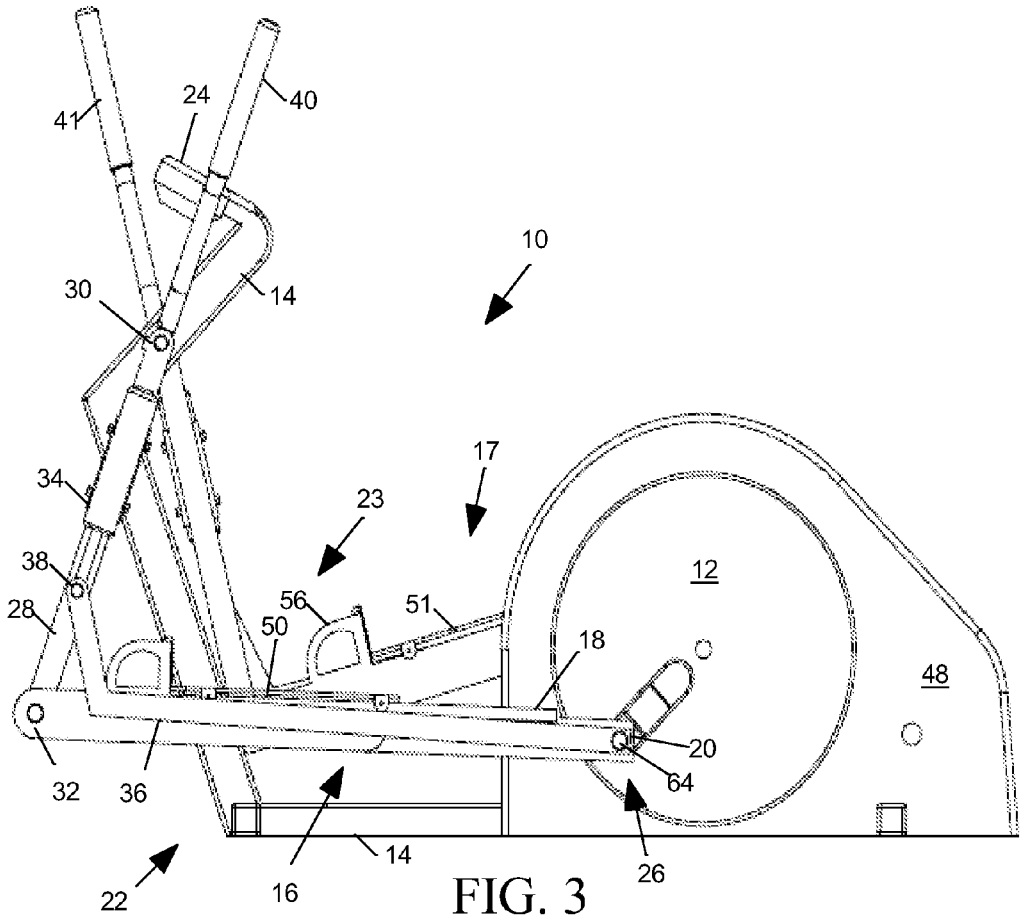
FIG. 3 is a left side elevation view of the exercise apparatus of FIG. 1.

As shown in FIGS. 2A and 2B, left footpad 50, includes a set of rollers 52 for rollably engaging upper channel member 18 and a flexible hook member 54 for grasping an upright member 56 attached to an upper channel member for limiting horizontal motion of footpad 50 along upper channel member 18. A strain gauge 58 mounted on hook member 54 supplies control panel 24 with an indicating signal of magnitude that varies as hook member 54 flexes. Strain gauge is 58 is biased so that its output signal magnitude is at a maximum when a user forces footpad 50 to the most forward position (toward rocker link 28) along channel member 18 allowed by hook member 54 and is at a minimum when the user forces footpad 50 the most rearward position (toward crank member 12) along channel member 18 allowed by flexible hook member 54. The magnitude of the output signal of strain gauge 58 is a measure of the horizontal force a user applies to footpad 50. Footpad 50 flexes as the user applies a downward force on the footpad, and another strain gauge 60, attached to the underside of footpad 50, provides control panel 24 with an output signal of magnitude that varies with the amount by which footpad 50 flexes. Thus the output signal of strain gauge 60 is a measure of the magnitude of the downward-directed vertical force a user applies to footpad 60. Flexible conductors (not shown) convey the output signals of strain gauges 58 and 60 to control panel 24. Right footpad 51 is similar to left footpad 50 and includes similar strain gauges.

Figure 4:
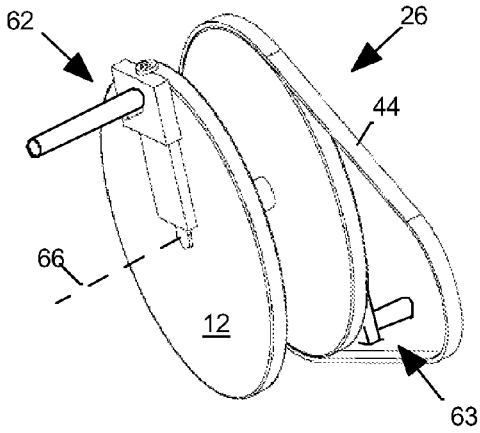
FIGS. 4 and 5 are perspective views of alternative versions of a crank assembly for the exercise apparatus of FIG. 1.

FIG. 4 depicts an example implementation of left side adjustable crank assembly 26 as including a linear actuator 62 attached to crank member 12 for adjustably controlling a distance between a crank rod 64 and the crank member's rotational axis 66. Crank rod 64 is coupled through bearings to footpad lower member 20 and drawbar 36. Linear actuator 62 includes a stepper motor controlled by signals from control panel 24 that are delivered to the stepper motor through wires coupling control panel 24 to brush contacts (not shown) on crank member 12. A similar adjustable crank assembly, including a linear actuator 63 is mounted on the right side of crank member 12 to form a portion of left side linkage assembly 23 of FIG. 1.

Figure 5:
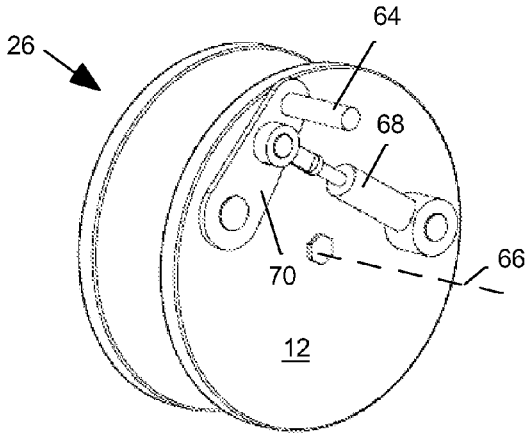

FIG. 5 shows an alternative version of left crank assembly 26 including a linear actuator 68 pinned to crank member 12 for adjustably rotating a lever arm 70 also rotatably pinned to crank member 12, thereby to adjust the distance between crank rod 64 attached to level arm 70 and crank member rotational axis 66. Linear actuator 68 includes a stepper motor controlled by signals from control panel 24 that are delivered to the stepper motor through wires coupling control panel 24 to brush contacts (not shown) on crank member 12. A similar adjustable right crank assembly mounted on the right side of crank member 12 forms a portion of right side linkage assembly 23 of FIG. 1.

Elliptical Motion

A user standing on right footpad 50 applies forces to footpad 50 and handlebar 40 that cause foot member 16 to follow an elliptical path defined by linkage assembly 22 and cause handlebar 40 to oscillate about bearing pin 30. We refer to the length of the elliptical path in the generally horizontal direction as the "stride length" and refer to the length of the elliptical path in the generally vertical direction as the "stride height". Actuators 34 and 62 of FIGS. 3 and 4 control the stride height and stride length by adjusting the shape of the elliptical path. The left side actuators 35 and 63 similarly control the stride length and stride height of the elliptical path followed by left footpad 51.

The "crank radius", the distance between pin 64 and the rotational axis 66 of crank member 12 controlled by actuator 62 of FIG. 4, influences the both stride height and stride height; as the crank radius increases, so too do stride height and stride length, The "rocker radius", the distance between bearing pins 30 and 38 controlled by linear actuator 34 also influences stride height but does not substantially influence stride height; as rocker radius increases, stride length decreases.

Figure 6A:
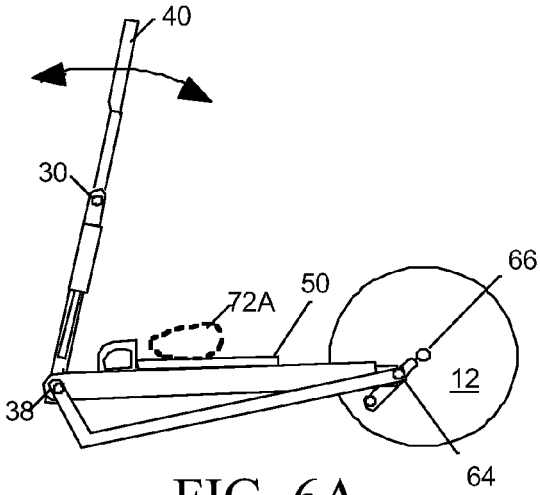
FIGS. 6A-6D are simplified side elevations views of portions of the exercise apparatus of FIG. 1.
Figure 6B:
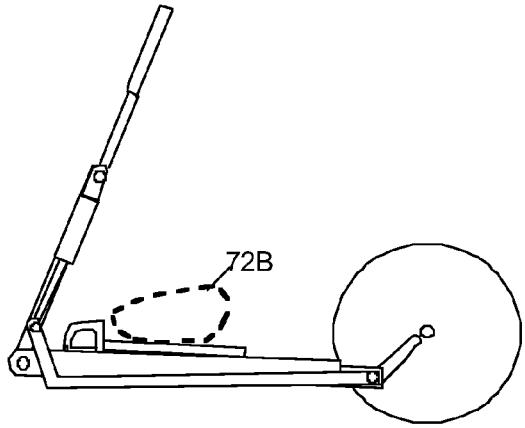
Figure 6C:
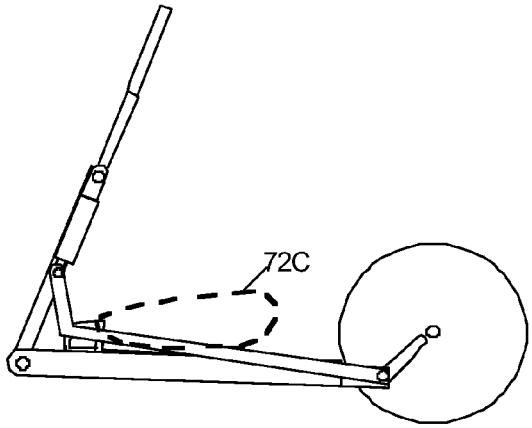
Figure 6D:
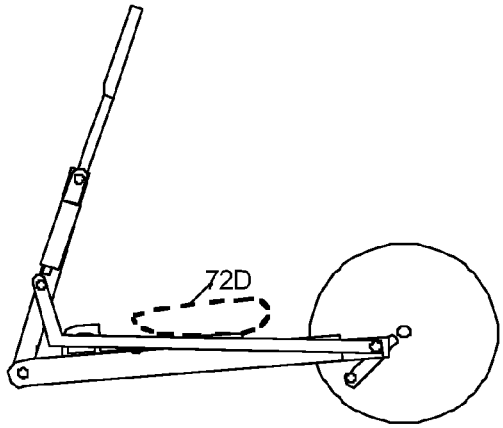

FIGS. 6A-6D show four example elliptical paths 72A-72D followed by a point on left footpad 50. In FIG. 6A, the crank radius is relatively small and rocker radius is relatively long, so both stride height and stride length of path 72A are small. In FIG. 6B, both crank radius and rocker radius are relatively large, so both stride length and stride and stride of path 72B are larger than in path 72A. In FIG. 6C, the rocker radius is relatively small and the crank radius is relatively large, so the stride length of path 72C is longer than in paths 72A and 72B and stride height is as large as in path 72B. In FIG. 6D, both rocker radius and crank radius are small, so stride length of path 72D is long, about the same as for path 72B, but stride height is small, about the same as in path 72A.

Thus the control system can adjust actuators 34 and 62 to provide a stride length ranging from the short stride length of path 72A to the long stride length of path 72C and to provide a stride height ranging from the short stride height of path 72A to the high stride height of path 72C. Although the crank radius controlled by actuator 62 influences both stride height and stride length, the control system can independently adjust stride height and stride length. For example, to increase or decrease stride length without affecting stride height, the control system can signal actuator 34 to decrease or increase the rocker radius without signaling actuator 62 to change crank radius. To increase stride height without affecting stride length, the control system can signal actuator 62 to increase the crank radius and can signal actuator 34 to increase the rocker radius. The increase in crank radius not only increases stride height, but also tends to increase stride length, the control system can offset the increase in stride length by appropriately increasing rocker radius so that there is no net increase in stride length. Conversely, to decrease stride height without affecting stride length, the control system can signal actuator 62 to decrease the crank radius and signal actuator 34 to appropriately decrease the rocker radius.

As discussed below, when exercise apparatus 10 is in a manual stride height or length adjustment mode, the control system adjusts stride height or length in response to use-operated pushbuttons mounted on control panel 24. When the exercise apparatus 10 is in an automatic stride height or length adjustment mode, the control system adjusts stride height or length in response to forces the user applies to footpads 50 and 51 which are sensed by strain gauges 58 and 60 of FIGS. 2A and 2B or by alternative means described below.

Control System

Figure 7:
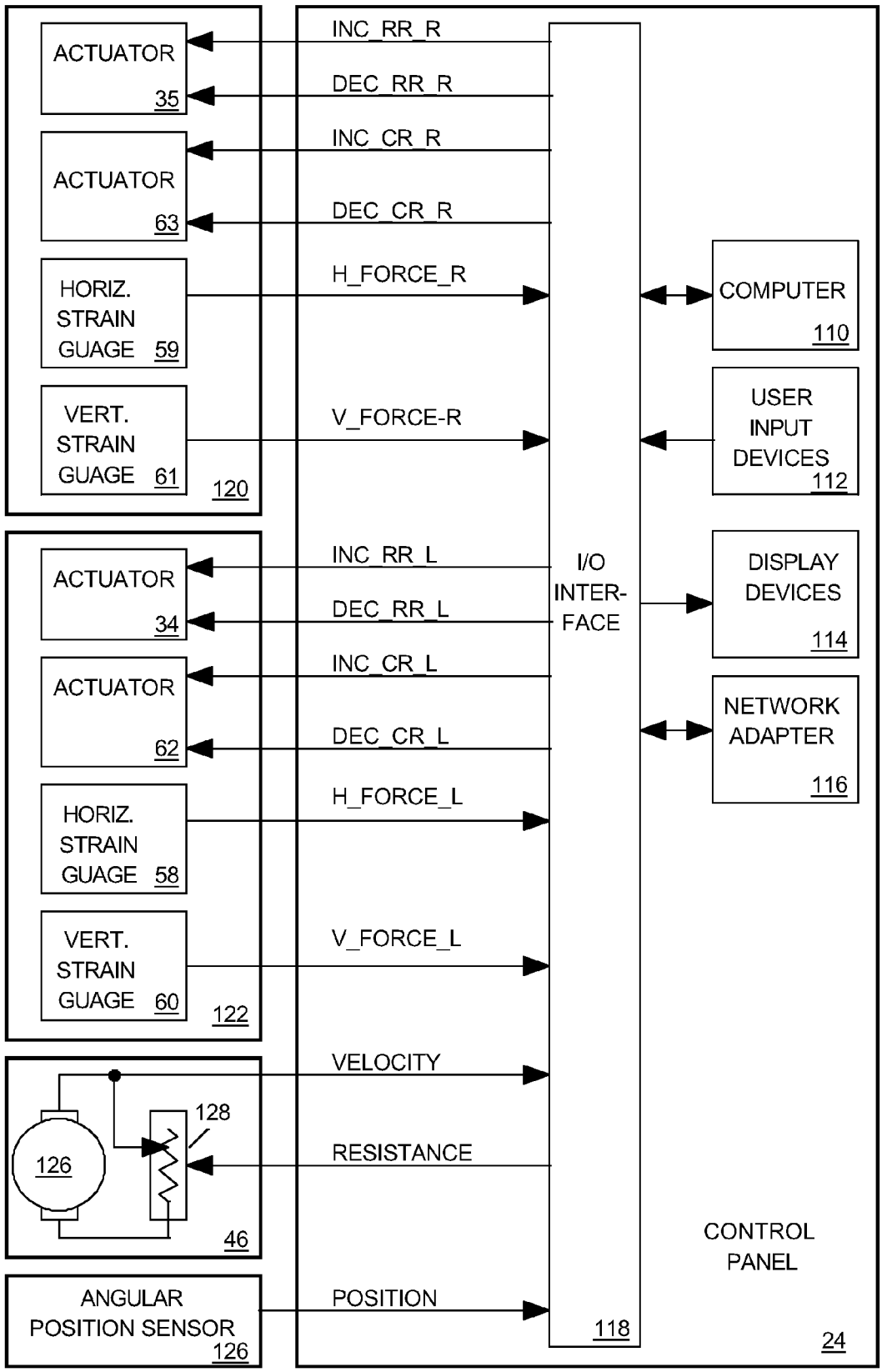
FIG. 7 is a block diagram an exercise control, monitoring and display system for the exercise apparatus of FIG. 1.

FIG. 7 is a block diagram showing a control system for exercise apparatus 10 of FIGS. 1-5 including a conventional computer 110 residing within control panel 24 and an I/O interface circuit 118 interfacing computer 100 to user input devices 112 and display devices 114 mounted on control panel 24, and a network adapter 116. User input devices 114 allow the user to input commands to computer and may include, for example, pushbuttons, control knobs, a keyboard and/or a touch screen. Display devices 114, which may include, for example, pushbutton lights, light emitting diodes, alphanumeric display panels, and/or a video monitor, allow computer 110 to present various kinds of information to the user. Network adaptor 116, which may be wireless, allows computer 110 to communicate with other computers via conventional network and Internet protocol for uploading programs and downloading or uploading data.

The control system also includes various sensor and control devices coupled to computer 110 via I/O interface circuit. Right side control devices and sensors 120 include actuators 35 and 63 and strain gauges 59 and 60. Left side control and sensor devices 122 include actuators 34 and 62 and strain gauges 58 and 60. Strain gauges 58-61 produce signals H_FORCE_R, H_FORCE_L, VFORCE_R and VFORCE_L, respectively, indicating the magnitudes of horizontal and vertical forces the user applies to footpads 50 and 51.

Regenerative brake 46 includes a generator 126 coupled for rotation with crank member 12 of FIGS. 1-4. Generator 126 generates an output voltage across a variable resistor 128 that increases with the generator's rotational velocity producing a current through resistor 128. Resistor 128 dissipates in the form of heat the rotational energy the user expends rotating generator 126. Under control of computer 110, I/O interface 118 transmits a signal RESISTANCE to resistor 128 that controls the electrical resistance of resistor 128, thereby controlling the mechanical resistance regenerative brake 46 provides to crank rotation. The voltage across resistor 128 is proportional to the angular velocity of crank rotation and is provided as a VELOCITY signal input to I/O interface circuit 118, which includes an analog-to-digital converter for converting the analog VELOCITY signal into digital data input to computer 110 indicting rotational velocity.

An angular position sensor 126 mounted within frame housing 48 of FIG. 1 provides a POSITION signal to I/O interface 118 indicating the angular position of crank member 12. In some embodiments of the invention, the VELOCITY signal may be omitted since computer 110 can alternatively compute velocity from changes in angular position indicated by the POSITION signal. Devices and circuits capable of carrying out the interface functions of I/O interface circuit 118 are well known to those of ordinary skill in the art.

Under control of computer 110, I/O interface circuit 118 transmits control pulses to actuators 34, 35, 62 and 63 via the following control signals. Each control signal pulse tells the receiving actuator to increment or decrement its length by a unit amount:

INC_CR_R to tell actuator 35 to increment right side crank radius,

DEC_CR_R to tell actuator 35 to decrement right side crank radius.

INC_RR_R to tell actuator 63 to increment right side rocker radius,

DEC_RR_R to tell actuator 63 to decrement right side rocker radius.

INC_CR_L to tell actuator 34 to increment left side crank radius,

DEC_CR_L to tell actuator 34 to decrement left side crank radius,

INC_RR_L to tell left actuator 62 to increment left side rocker radius, and

DEC_RR_L to tell actuator 62 to decrement left side rocker radius.

Actuators 34, 35, 62 and 63 include internal limit switches to prevent computer 110 from signaling them to drive rocker radius or crank radius beyond their maximum or minimum limits. During system startup, computer 110 sends a sufficient number of pulses to each actuator to ensure that crank radius is at a minimum and rocker radius is at a maximum. Thereafter, computer 110 keeps track of the number of increment and decrement pulses it sends to each actuator in order to keep track of each crank and rocker radius. Computer 110 maintains a lookup table in its memory that relates crank and rocker radius to stride length and stride height. Whenever computer 110 needs to increment or decrement stride height or stride length, it uses the lookup table to determine the amount by which it must increment or decrement rocker radius and/or crank radius in order to achieve the desired change in stride height or length.

Stride Length Adjustment

The user can command computer 110 to operate in either a manual stride length adjustment mode wherein computer 110 and I/O interface circuit 118 control right and left stride length as a function of user input supplied via user input devices 112 or in an automatic stride length adjustment mode in which computer 110 and I/O interface circuit 118 automatically control right and left stride length based on sensor output.

Figure 8:
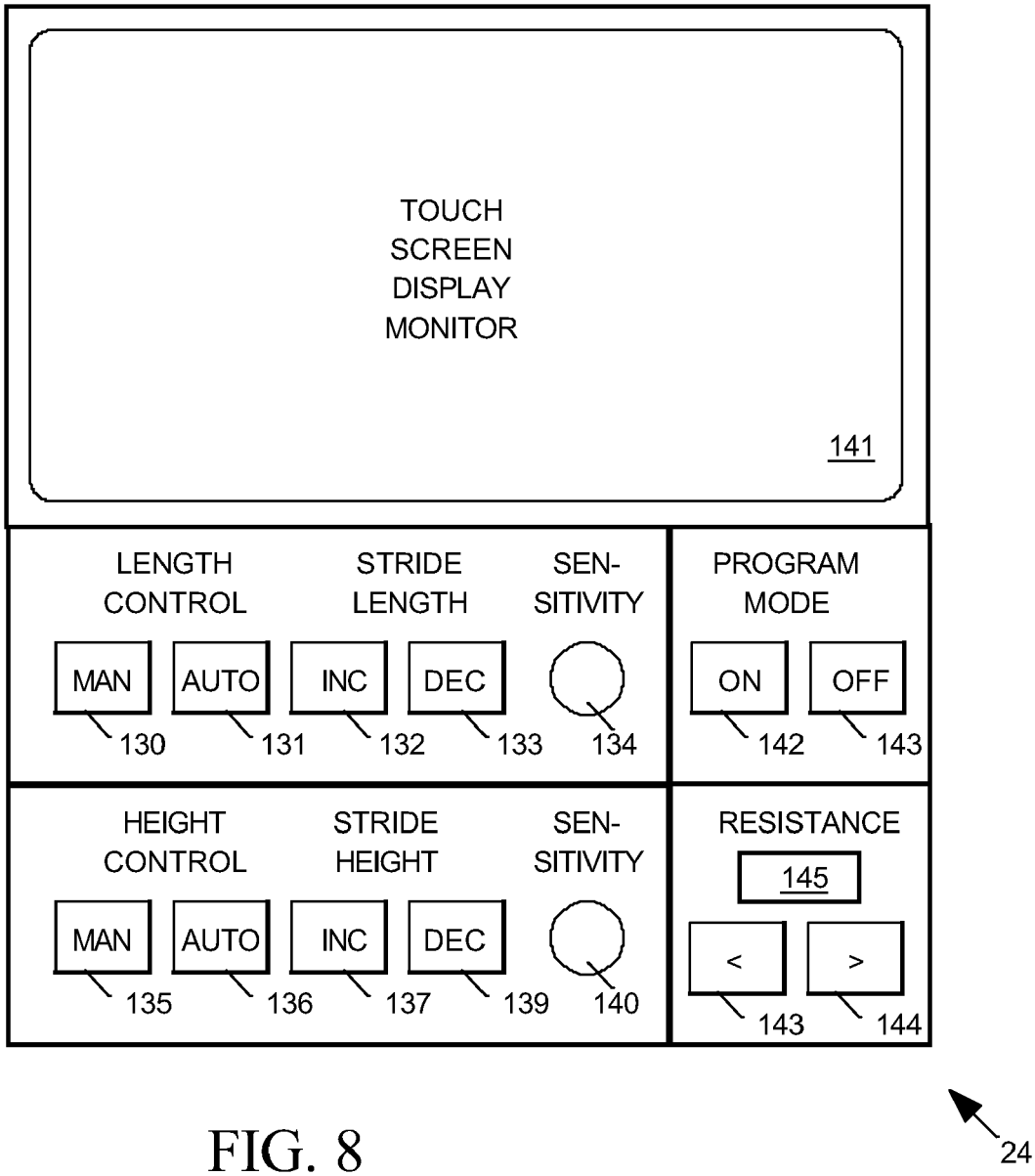
FIG. 8 is a plan view of the control panel of FIG. 1.

As shown in FIG. 8, the user input devices 112 on control panel 24 may include, for example, separate lighted pushbuttons 130 and 131 enabling the user to select between manual and auto stride length adjustment modes, with pushbutton 130 or 131 being illuminated to indicate the current mode of operation. When in the manual stride length adjustment mode, computer 110 signals I/O interface circuit to increase or decrease stride length in response to user input via separate pushbuttons 132 and 133 and a stride length sensitivity knob 134 allows the user control the amount by which computer 110 signals actuators 34, 35, 62 and/or 63 to increase or decrease stride length each time the user presses button 132 or 133.

In the automatic stride length adjustment mode, computer 112 adjusts left and right stride length in response to a combination of information contained in the H_FORCE_R and H_FORCE_L output signals of the right and left horizontal strain gauges 58-61 and the POSITION output signal of angular position sensor 126 of FIG. 7 indicating the angular position of crank rod 64 of FIG. 1. As discussed above, left drawbar link 36 of linkage mechanism 22 is rotatably connected to crank member 12 via crank rod 64, and as crank rod 64 rotates about the axis 66 of crank member 12, linkage mechanism 22 causes right left member 36 and left footpad 50 to oscillate back and forth through a horizontal distance controlled by actuators 34 and 62.

Figure 9:
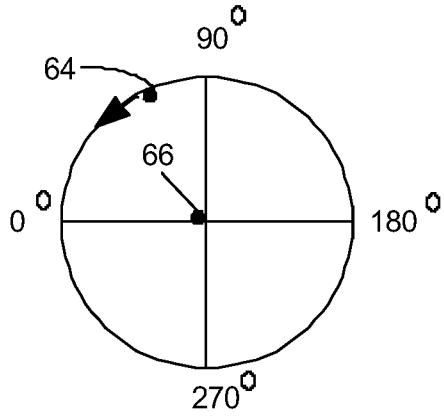
FIG. 9 is a diagram defining position of the crank member of FIG. 1.

FIG. 9 depicts the circular path of crank rod 64 about the axis 66 of crank member 12. When crank rod 64 is at its maximum forward position, left footpad 50 has reached its maximum forward position, right footpad 51 has reached its maximum rearward position, and the POSITION signal output of position sensor 126 indicates that crank rod 64 is at 0 degrees. Conversely, when crank rod 64 reaches its maximum rearward position, left footpad 50 reaches its maximum rearward position, right footpad 51 reaches its maximum forward position, and the POSITION signal output of position sensor 126 indicates crank rod 64 is at 180 degrees.

A user rotates crank member 12 by shifting most of his or her weight to left side footpad 50 while crank rod 64 is moving counterclockwise from 90 to 270 degrees, and by shifting most of his or her weight to right side footpad 51 when crank rod 64 is moving counterclockwise from 270 to 90 degrees. The percentage of the user's weight allocated to the right and left during each half cycle of crank rotation controls the downward vertical forces the user applies to footpads 50 and 51 and affects the rotational velocity of crank member 12. Vertical stain gauges 60 and 61 sense the vertical forces on the footpads. The user's leg muscles can also apply forward and rearward directed horizontal forces to footpads 50 and 51 that are sensed by left and right horizontal strain gauges 58-61. The horizontal forces on footpads 50 and 51 also affect rotational velocity, but normally to a lesser extent than the vertical forces.

In the automatic stride length adjustment mode, computer 110 automatically increases or decreases stride length by increasing or decreasing the lengths of actuators 34, 35, 62 and 63 in response to the H_FORCE_L and H_FORCE_R signals produced by horizontal strain gauges 58 and 59 and the POSITION signal produced by position sensor 126. We define the following horizontal forces as being positive in the forward direction from the user's point of view:

$F_{HL}$: horizontal force on left footpad 50, $F_{HR}$: horizontal force on right footpad 51, $F_{HHT}$: a high horizontal threshold level force, and $F_{LHT}$: a low horizontal threshold level force, Computer 110 stores parameters indicating the high and low horizontal threshold forces $F_{HHT}$ and $F_{LHT}$ as user adjustable constants in its memory. In the automatic stride length adjustment mode, computer 110 signals interface circuit 118 to carry out the following operations:

Increment left side stride length when $F_{HL}>F_{HHT}$ and crank rod 64 resides between 80 and 100 degrees, Increment right side stride length when $F_{HR}>F_{HHT}$ and crank rod 64 resides between 260 and 280 degrees, Decrement left side stride length when $F_{HL}<F_{LHT}$ and crank rod 64 resides between 80 and 100 degrees, and Decrement right side stride length when $F_{HR}<F_{LHT}$ and crank rod 64 resides between 260 and 280 degrees.

When computer 110 follows the above rule, a user quickly learns that sufficiently increasing or decreasing the horizontal forces of a footpad when the footpad is at the top of its forward stride will cause an increase or decrease in stride length. Although the position ranges for crank rod 64 suggested above are provided for illustrative purposes, those of skill in the art will appreciate that in other embodiments of the invention, the computer may employ position ranges that vary from those indicated above when testing for the user's desire to increase or decrease stride length.

Figure 10:
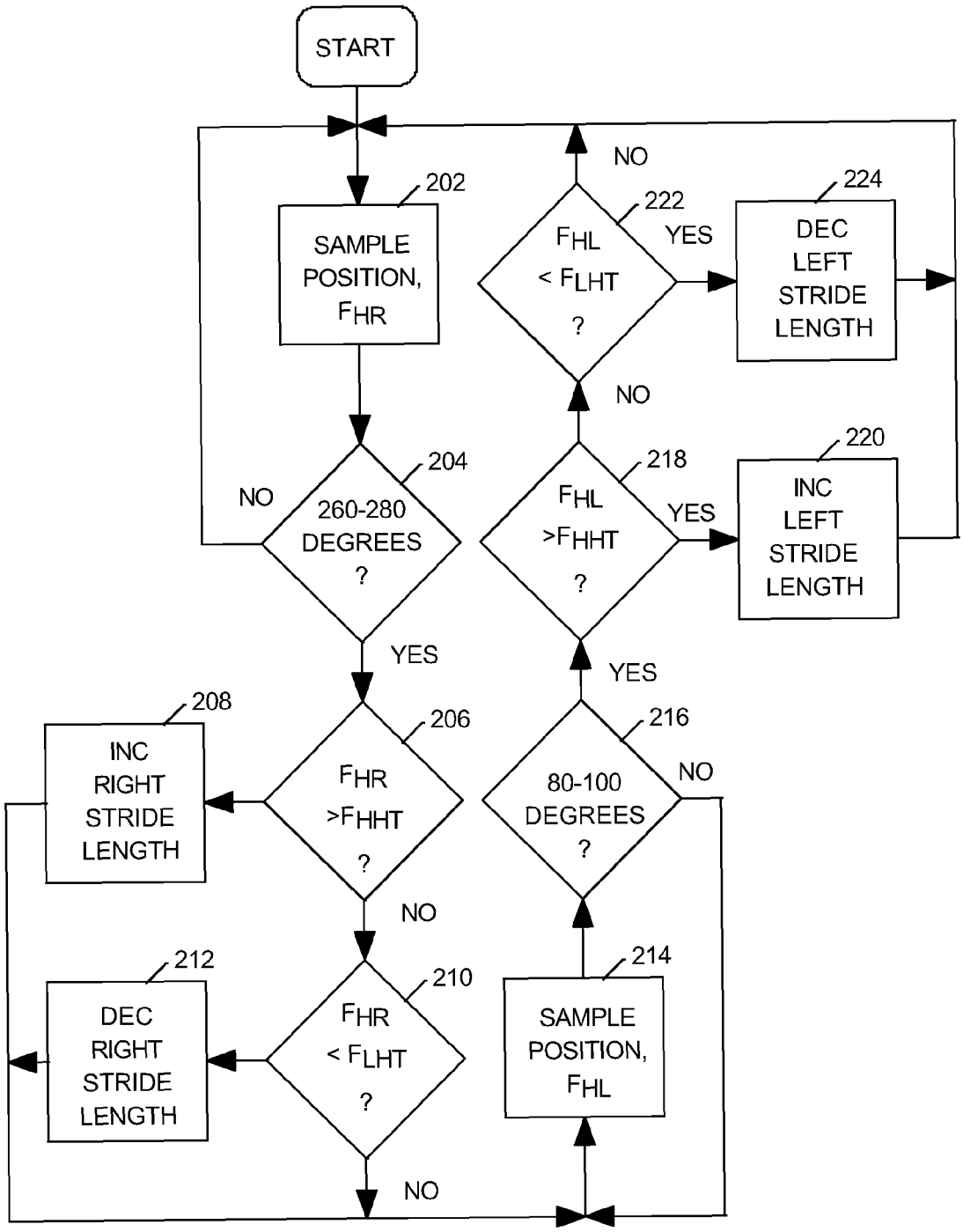
FIG. 10 depicts a software routine executed by the computer of FIG. 7 for automatically controlling stride length.

FIG. 10 is a flow chart for a program executed by computer 110 when in the automatic stride length adjustment mode. Computer 110 initially iteratively samples the right horizontal force data $F_{HR}$ and the POSITION data provided by interface circuit 18 (step 202) until it determines from the POSITION data that crank rod 64 resides between 260-280 degrees (step 204). If the last sampled value of right horizontal force data $F_{HR}$ exceeds the high horizontal threshold level force $F_{HHT}$ (step 206), computer 110 signals interface circuit 118 to increment the right stride length (step 208). If the last sampled value of right horizontal force data $F_{HR}$ is less than the low horizontal threshold level force $F_{LhT}$ (step 210), computer 110 signals interface circuit 118 to decrement the right stride length (step 212). After step 208 or 212, or after step 210 if the last sampled value of right horizontal force data $F_{HR}$ is between the low horizontal threshold level force $F_{LHT}$ and the high horizontal level threshold force $F_{HHT}$, computer 110 begins iteratively sampling the left horizontal force data $F_{HL}$ and the POSITION data supplied by interface critic 118 (step 214) until it determines from the POSITION data that crank rod 64 resides between 80 and 100 degrees (step 216). If the last sampled value of left horizontal force data $F_{HL}$ exceeds the high threshold level force $F_{HHT}$ (step 218), computer 110 signals interface circuit 118 to increment the left stride length (step 220). If the last sampled value of left horizontal force data $F_{HL}$ is less than the low threshold level force $F_{LHT}$ (step 222), computer 110 signals interface circuit 118 to decrement the left stride length (step 224). After step 220 or 224, or after step 222 if the last sampled value of left horizontal force data $F_{HL}$ is between the low horizontal threshold level force $F_{LHT}$ and the high horizontal level threshold force $F_{HHT}$, computer 110 returns to step 202. Note that computer 110 increments or decrements right or left stride length at most only once during each rotational cycle. The amount by which computer 110 increases left or right stride length at step 208 or 220 increases with the amount by which the last sampled horizontal force $F_{HR}$ or $F_{HL}$ exceeds the high threshold level $F_{HL}$. Similarly, the amount by which computer 110 decreases left or right stride length at step 212 or 224 increases with the amount by which the low threshold level $F_{HL}$ exceeds the last sampled horizontal force $F_{HR}$ or $F_{HL}$.

Thus in the automatic stride length adjustment mode, the user can maintain a constant stride right and left stride lengths by keeping the horizontal forces on the left and right footpads 50 and 51 between the high and low horizontal threshold levels $F_{HHT}$ and $F_{LHT}$ while the left or right footpad is near its high point and moving forward, and can increase or decrease left or right stride length by increasing or decreasing the horizontal force on right or left footpad 50 or 17 above or below the high or low threshold levels while the footpad is near its high point and moving forward. The particular ranges of positions employed at decision steps 204 and 216 are a matter of design choice and can vary from those shown in FIG. 10. For example at step 204 computer 110 could determine whether crank rod 64 is within a range of 90-120 degrees and at step 216 computer 110 could determine whether crank rod 64 is in a range of 270-300 degrees. In the automatic stride length adjustment mode, the user can adjust the values of the two threshold level force constants $F_{LHT}$ and $F_{HHT}$ up or down using stride length sensitivity knob 134. Computer 110 displays the current stride height and length and the current threshold levels $F_{LHT}$ and $F_{HHT}$ on display monitor 114. In the preferred embodiment of the invention, right and left stride paths, including their lengths and heights, are independently adjustable, which is advantageous because users having non-symmetric leg strengths sometimes prefer slightly differing right and left strides. In other embodiments of the invention, computer 110 automatically adjusts right and left stride height and/or length concurrently so they are always similar. This could be implemented, for example, by changing the algorithm of FIG. 10 so that at steps 208 and 220 both right and left stride lengths are incremented and so that at steps 212 and 224 both right and left stride lengths are decremented.

In the preferred embodiment of the invention, pushbuttons and knobs 132-134 allow the user to control right and left stride lengths concurrently when the computer is operating in the manual stride adjustment mode so that they are always similar.

However additional pushbuttons can be provided on control panel 24 to allow the user to independently increment and decrement right and length stride length when computer 110 is operating in the manual stride length adjustment mode.

Stride Height Adjustment

The user can also command computer 110 to operate in either a manual stride height adjustment mode wherein the user directly controls stride height via user input devices 112 or in an automatic height length adjustment mode in which the computer automatically controls stride height based on sensor input.

As shown in FIG. 8, the user input devices 112 on control panel 24 may include, for example, separate lighted pushbuttons 135 and 136 enabling the user to select between manual and auto stride height adjustment modes, with pushbutton 135 or 136 being illuminated to indicate the current mode of operation. When in the manual stride height adjustment mode, computer 110 signals I/O interface circuit to increase or decrease stride height in response to user input via separate pushbuttons 137 and 138 and a stride height sensitivity knob 140 allows the user control the amount by which computer 110 increases or decreases stride length each time the user presses button 137 or 138. While the preferred embodiment of the invention provides switches and knobs 130-140 for the above-described user input functions, one of skill in the art will appreciate that input devices 112 provided for these function are a matter of design choice and can be implemented by any of a variety of devices including, for example, keyboards, keypads, touch screens, and the like.

In the automatic stride height adjustment mode, computer 112 adjusts left and right stride height in response to a combination of information contained in the V_FORCE_R and V_FORCE_L output signals of the right and left horizontal strain gauges 100 and 101 and the POSITION output signal of angular position sensor 126 of FIG. 7. We define the following vertical forces on the footpads as being positive in the upward direction and negative in the downward direction from the user's point of view:

$F_{VR}$: vertical force on right footpad 51, $F_{VL}$: vertical force on left footpad 50, $F_{HVT}$: a high vertical threshold level force, and $F_{LVT}$: a low vertical threshold level force.

Interface circuit 118 converts the V_FORCE_R and V_FORCE_L output signals of the right and left horizontal strain gauges 100 and 101 into data representing the vertical forces $F_{VR}$ and $F_{VL}$ the user applies the left and right footpads 50 and 51 and permits computer 110 to read access that data. Computer 110 stores the high and low vertical threshold forces $F_{HVT}$ and $F_{LVT}$ as user adjustable constants in its memory.

Assuming upward directed vertical forces are positive, the vertical forces $F_{VR}$ and $F_{VL}$ the user applies to the left and right footpads 50 and 51 are negative (downward directed) and vary as the user rotates crank member 12 by shifting his or her weight from one footpad to the other during each rotation cycle. When crank rod 64 resides between 90 and 100 degrees, most of the user's weight will be on right footpad 51 but the user will normally continue to apply a modest downward force on left footpad 50. However it is possible for the user to shift all or almost all of his or her weight to right footpad 51 when crank rod 64 is between 90 and 100 degrees thereby causing vertical force $F_{VL}$ on left footpad 50 greater (less negative) than a small negative threshold force $F_{HVT}$. In the automatic stride height adjustment mode, computer 118 increases left side stride height when $F_{VL}$ is greater (less negative) than $F_{HVT}$ when crank rod 64 is between 90 and 100 degrees. Thus the user can signal computer 110 to increase left side stride height by removing most of all of his or her weight from footpad 50 when crank rod 64 is between 90 and 100 degrees. Similarly, computer 118 increases right side stride height when $F_{VL}$ is greater (less negative) than $F_{HVT}$ when crank rod 64 is between 270 and 280 degrees. Thus the user can signal computer 110 to increase left side stride height by removing most of all of his or her weight from footpad 51 when crank rod 64 is between 270 and 280 degrees.

In the automatic stride height adjustment mode, computer 118 decreases left side stride height when $F_{VR}$ is less than (more negative) than a low vertical threshold level $F_{LVT}$ when crank rod 64 is between 90 and 100 degrees. Thus the user can signal computer 110 to decrease left side stride height by shifting a sufficient amount of all of his or her weight to left footpad 50 when crank rod 64 is between 90 and 100 degrees. Similarly, computer 118 decreases right side stride height when $F_{VK\backslash L}$ is less (more negative) than $F_{VT}$ when crank rod 64 is between 270 and 280 degrees. Thus the user can signal computer 110 to decrease right side stride height by a sufficient amount of his or her weight to right footpad 51 when crank rod 64 resides between 270 and 280 degrees. In the automatic stride height adjustment mode, the user can adjust the magnitude of low vertical threshold level $F_{LVT}$ using stride height sensitive control knob 140 and computer 110 signals interface circuit 118 to carry out the following operations:

Increment left side stride height when $F_{VL}>F_{HVT}$ and crank rod 64 resides between 90 and 100 degrees, Increment right side stride height when $F_{VR}>F_{HVT}$ and crank rod 64 resides between 270 and 280 degrees, Decrement left side stride height when $F_{VL}<F_{LVT}$ and crank rod 64 resides between 90-100 degrees, and Decrement right side stride height when $F_{VR}<F_{LVT}$ and crank rod 64 resides between 270 and 280 degrees.

The position ranges for crank rod 64 discussed above are provided for illustrative purposes. Those of skill in the art will appreciate that in other embodiments of the invention, the computer may employ position ranges that vary from those indicated above when testing for the user's desire to increase or decrease stride height and the user will learn to apply the appropriate vertical forces to the footpad at the appropriate points along their paths as needed to initiate desired changes in stride height.

Figure 11:
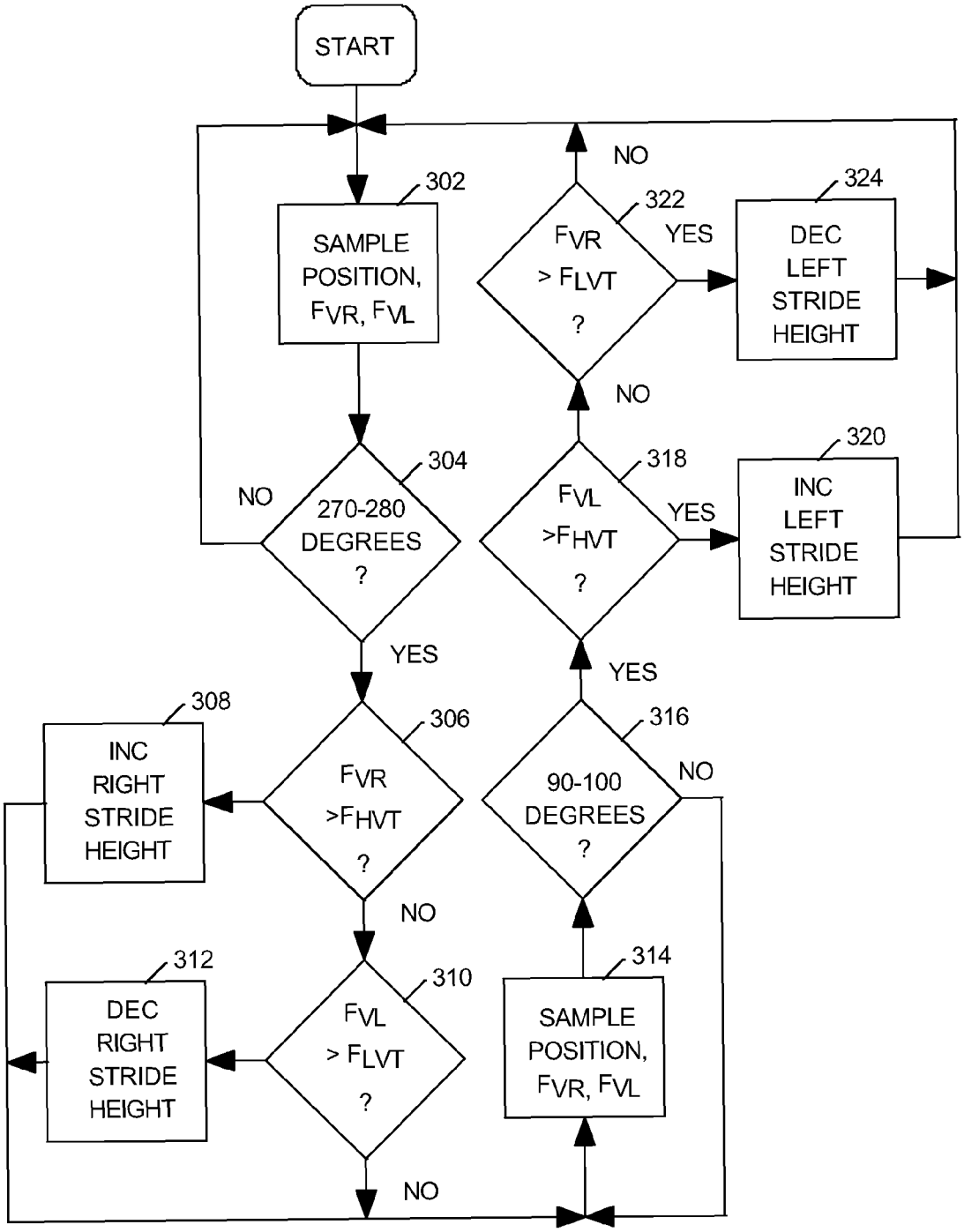
FIG. 11 depicts a software routine executed by the computer of FIG. 7 for automatically controlling stride height.

FIG. 11 is a flow chart for a program executed by computer 110 when in the automatic stride height adjustment mode. Computer 110 initially iteratively samples the right and left vertical force data $F_{VR}$ and $F_{VL}$ and the POSITION data provided by interface circuit 18 (step 302) until it determines from the POSITION data that crank rod 64 resides between 270 and 280 degrees (step 304). If the last sampled value of right vertical force data $F_{VR}$ exceeds the positive high threshold level force $F_{HVT}$ (step 306), computer 110 signals interface circuit 118 to increment the right stride height (step 308). If the last sampled value of left vertical force data $F_{VL}$ exceeds low threshold level force $F_{LVT}$ (step 310), computer 110 signals interface circuit 118 to decrement the left stride height (step 312). After step 308 or 312, or after step 310 if results of both steps 306 and 310 are "NO", computer 110 resumes iteratively sampling the right and left vertical force data $F_{VR}$ and $F_{VL}$ and the POSITION data (step 314) until it determines from the POSITION data that crank rod 64 resides between 260 and 280 degrees (step 316). If the last sampled value of left vertical force data $F_{VL}$ exceeds the high threshold level force $F_{HVT}$ (step 318), computer 110 signals interface circuit 118 to increment the left stride height (step 320). If the last sampled value of left vertical force data $F_{HL}$ exceeds the low threshold level force $F_{LVT}$ (step 322), computer 110 signals interface circuit 118 to decrement the left stride height (step 324). After step 320 or 324 or after step 322 if the result of both steps 318 and 322 is "NO", computer 110 returns to step 302. Note that computer 110 increments or decrements right or left stride height at most only once during each rotational cycle. The amount by which computer 110 increases or decreases left or right stride height at step 308, 312, 320 or 324 increases with the amount by which the last sampled vertical force $F_{HR}$ or $F_{HL}$ exceeds the high or low threshold level $F_{VHT}$ or $F_{VHT}$.

Thus in the automatic stride height adjustment mode, the user can maintain a constant right and left stride height by keeping the vertical forces on the right and left footpads 50 and 51 between the high or low threshold levels $F_{VHT}$ or $F_{VHT}$ while the footpads are approaching their high points. The user can increase right or left stride height by lifting his right or left foot off the right or left footpad 50 or 17 as it nears its high point and can decrease right or left stride height by pushing down sufficiently hard on the right or left footpad 50 or 17 as it nears its high point.

In the preferred embodiment of the invention, right and left stride height are independently adjustable in the automatic mode, which is advantageous because users having non-symmetric legs sometimes prefer slightly differing right and left stride heights. In other embodiments of the invention, computer 110 can automatically adjust right and left stride height concurrently so they are always similar. This could be implemented, for example, by changing the algorithm of FIG. 10 so that at steps 308 and 320 both right and left stride heights are incremented and so that at steps 312 and 324 both right and left stride heights are decremented.

In the preferred embodiment of the invention, pushbuttons and knobs 137-140 allow the user to control right and left stride height concurrently when the computer is operating in the manual stride adjustment mode so that they are always similar. However additional pushbuttons can be provided on control panel 24 to allow the user to signal computer 110 to independently increment and decrement right and stride height when computer 110 is operating in the manual stride height adjustment mode.

Those of skill in the art will also appreciate that the particular ranges of positions employed at decision steps 304 and 316 are a matter of design choice and can vary from that shown in FIG. 10. For example at step 304 computer 110 could determine whether crank rod 64 is within a range of 90-120 degrees and at step 316 computer 110 could determine whether crank rod 64 is in a range of 270-300 degrees.

Stride Length Control Based on Angular Velocity and Position

In the automatic stride length control mode, computer 110 determines when to increase or decrease stride length base as a function of the POSITION signal output of angular position sensor 126 and of the H_FORCE_R and H_FORCE_L output signals of horizontal strain gauges 59 and 60. In an alternative embodiment of the invention, computer 110 determines when to change stride length as a function of the POSITION signal and the VELOCITY signal output of regenerative brake 46, thereby eliminating the need for horizontal strain gauges 59 and 60. This is particularly advantageous in an exercise apparatus that does not provide automatic stride height control mode and therefore does not require vertical strain gauges 60 and 61. Eliminating the need for all strain gauges 98-101 reduces the complexity of footpads 50 and 51 and allows them to be formed as integral parts of foot members 16 and 17 and the wiring needed to deliver the strain gauge output signals to control panel 24 can be eliminated.

Figure 12:
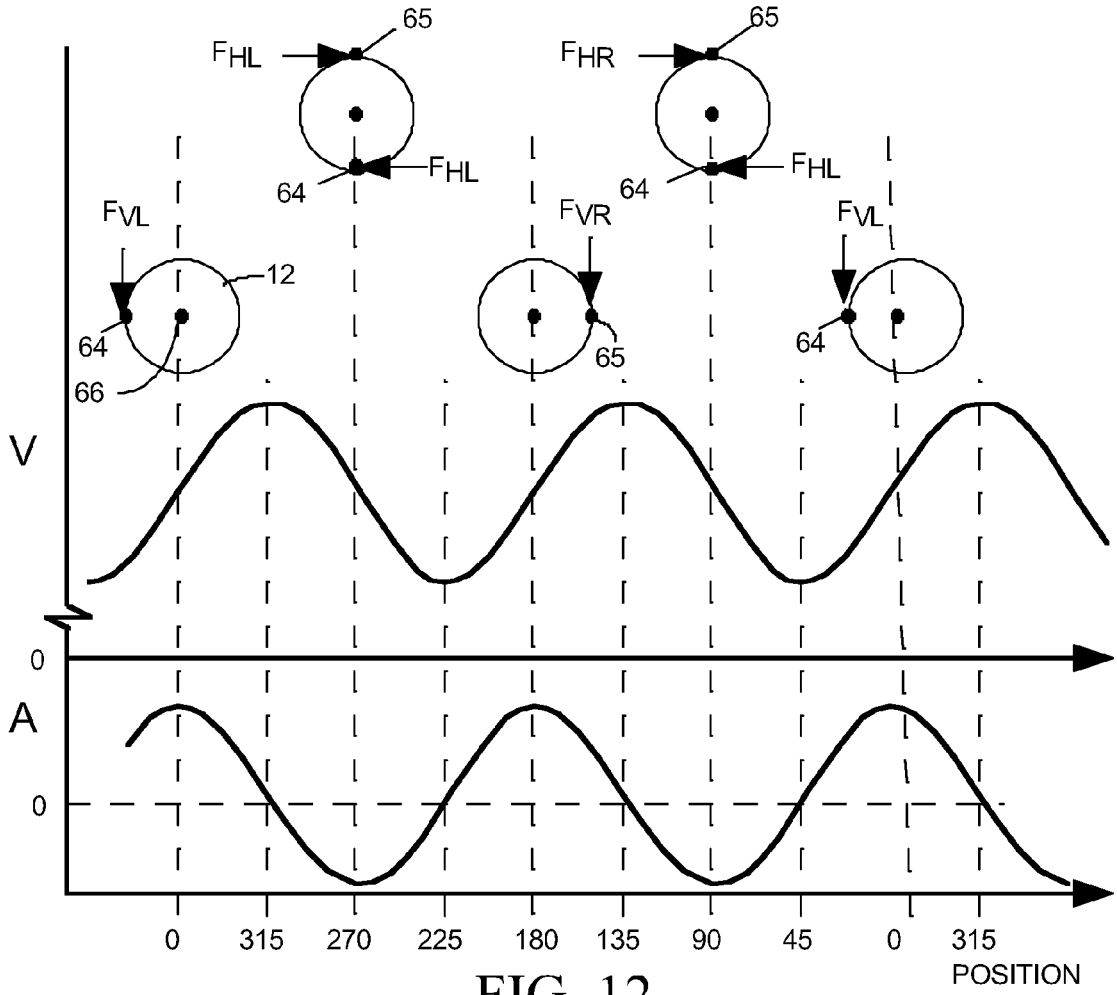
FIG. 12 graphically depicts the angular velocity and acceleration of the crank member of the apparatus of FIG. 1 as functions of angular position.
Figure 13:
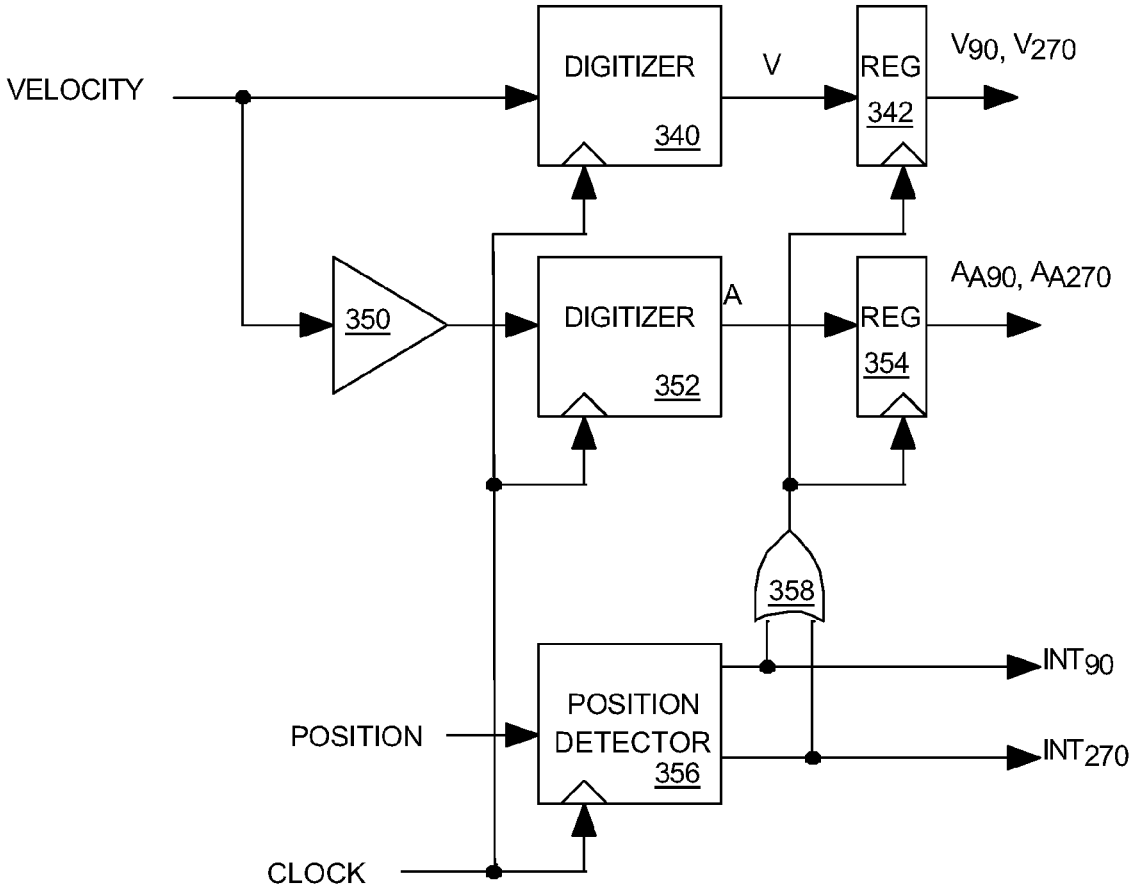
FIG. 13 is a block diagram depicting a subcircuit of I/O circuit 118 of FIG. 7.

FIG. 12 plots the magnitude V of the VELOCITY signal as a function of both time and crank position as the user moves footpads 50 and 51 through a full rotation cycle of crank member 12 as indicated by the POSITION signal output of angular position sensor 128. FIG. 13 plots the acceleration A of crank member 12 as a function the angular position of crank rod 64. FIG. 12 also graphically depicts at angular positions 0, 270, 180 and 90 degree positions of crank rod 64 of FIG. 1 as it rotates about crank axis 66 as indicated by the POSITION signal and shows the direction of the horizontal and vertical forces on crank. crank resulting from user forces applied to the footpads.

At 0 degrees, the user applies the majority of his or her weight on footpad 50 to apply a net downward force $F_{VL}$ on crank rod 64 which accelerates crank rotation by overcoming resistive forces applied by regenerative brake 46. Since at 0 degrees, crank rod 64 is at its maximum horizontal distance from crank axis 66 of cranks 20 the net vertical force $F_{VL}$ on crank rod 64 maximally accelerates crank member 12 as indicated by the rapidly increasing magnitude V of the VELOCITY signal at the 0 degree position. As crank rod 64 approaches 270 degrees, crank acceleration declines due to the decreasing leverage afforded by the declining horizontal distance between crank rod 64 and crank axis 66 and because the user has begin shifting his or her weight between footpads 50 and 51 so that the forces on left crank rode 64 and its right crank rod counter part 65 tend to cancel one another with respect to accelerating crank member 12. Angular velocity peaks at about 315 degrees when the rotational forces provided by the user fall below the resistive forces provided by regenerative brake 14. As crank rod 64 reaches its 270 degree position, the vertical forces on crank rods 64 and 65 have no effect on acceleration and crank deceleration is at a maximum, as indicated by the large negative slope of VELOCITY signal magnitude V. Velocity continues to decline to a minimum when crank rod 64 reaches its 225 degree position. Maximum rotational acceleration is again achieved when crank rod 64 reaches 180 degrees due to the large net vertical force on pin 45 at a maximum horizontal distance from crank axis 66.

FIG. 12 plots angular velocity V and acceleration of crank rod 64 of FIG. 1 as a function of the angular position of crank rod 64 during one cycle of pin rotation and also graphically depicts the net vertical forces $F_{VR}$ and $F_{VL}$ the user applies to pins 64 and 65 4 and the horizontal forces $F_{HR}$ and $F_{HL}$ the user applies to points 44 and 45. FIG. 12 is drawn with the assumption that the user is maintaining a steady pace and that $F_{HL}$ and $F_{HR}$ are zero because the user is applying no horizontal forces to footpads 50 and 51.

Even when the user pedals at a constant rate to provide a constant average angular velocity, the instantaneous angular velocity V will vary as shown in FIG. 12 during each cycle of rotation. At the 0 and 180-degree positions, acceleration A is at its positive maximum positive because $F_V$, being maximally horizontally displaced from crank member axis 66, rapidly accelerates the crank. At the 90 and 270 degree positions, acceleration is at its negative minimum because $F_V$, having no horizontal displacement from crank member axis 66, has no effect on crank acceleration and the crank rapidly decelerates due to the resistive force on crank member 12 provided by brake 46. The "net vertical force" $F_V$ is defined as the difference between the vertical forces $F_{VR}$ and $F_{VL}$ via crank rods 64 and 65 and is directed at the point receiving the larger of the two forces The user could increase his or her pace by increasing the net force $F_V$ applied to applied to crank rods 64 and 64, and in such case, both the velocity and acceleration curves of FIG. 12 would trend upward until the resistance provided by regenerative brake 46, which increases with rotational velocity, balances the increased cranking force provided by the user. At that point the velocity curve would look similar to that of FIG. 12, but would be shifted upward.

Acceleration A at any given position P of crank rod 64 is a function of the net vertical force $F_V$ on the crank rods 64 and 65 applied via lifter links 70 and 71 of FIG. 1, the net horizontal forces $F_H$ on crank rods 64 and 65 and the resistive force $F_R$ provided by regenerative brake 46, and the angular position P of crank rod 64.

$$A=f(F_V,F_{HR},F_{HL},F_{R,P})$$

The resistive force $F_R$ provided by regenerative brake 46 is a function of the rotational velocity V of the crank member 12 and the magnitude of the resistance R of resistor 128 of FIG. 7. Thus $$A=g(F_V,F_{HR},F_{HL,V,R,P})$$

When the user applies no horizontal forces $F_{HL}$, $F_{HR}$ to footpads 50 and 51, then the negative crank acceleration at the 270 degree position of crank rod 64 arises only from resistive force $F_R$ due to V and R because the net vertical force $F_V$ is zero when P=270 degrees. Thus the expected acceleration A at the 270 degree position when net horizontal forces are 0, $$A=g(0,0,0,V,R,270)$$

We define a variable $A_{E270}$ as an "expected" crank acceleration for a given velocity at the 270 degree pin position when horizontal forces $F_{HL}$, $F_{HR}$ on crank rods 64 and 65 are zero. The expected 270 degree position crank acceleration $A_{E270}$ is a function only of V and R.

$$A_{E270}=h(V,R)$$

The expected acceleration $A_{E90}$ at the 90-degree position of crank rod 64 is a similar function of V and R when horizontal forces on crank rods 64 and 65 are zero.

$$A_{E90}=h(V,R)$$

During each crank cycle, computer 110 samples the POSITION and VELOCITY signals to determine the magnitude V of crank velocity whenever the POSITION signal indicates crank rod 64 is at either the 90 or 270 degree position. Knowing the value to which it most recently set resistance R, computer 110 then computes $A_{E90}$ and $A_{E270}$ based on a stored equation or lookup table model of the above function h(V,R). The function is experimentally determined at the factory at the time the exercise apparatus is built and then stored in non-volatile memory of computer 110.

Stride Height and Length Control for Backward Mode Operation.

Referring to FIG. 1, when the user operates exercise apparatus 10 in a "forward mode" as described above such that crank rod 64 rotates counter-clockwise about the axis of crank member 12 as viewed from the left side of the apparatus, the user's feet will move in much the same way as the would if the user were walking forward on a flat surface. However the user can alternatively operate exercise apparatus 10 in a "backward mode" by rotating crank rod 64 in a clock-wise direction, thereby moving his or her feet in a manner similar to walking backwards. Computer 110 determines whether the user is operating the apparatus in the forward or backward mode based on how the POSITION signal output of angular position sensor 126 changes with time. During backward mode operation, when the user has selected automatic stride height and/or length control, computer 110 automatically adjusts stride height and/or length based on user applied forces using algorithms substantially similar to the forward walking mode algorithms described above, except that the angular positions at which user forces are sensed differ in the reverse mode. In the backward mode computer 110 will carry out the following actions:

Increment left side stride height when $F_{VL}>F_{HVT}$ and crank rod 64 resides between 80 and 90 degrees, Increment right side stride height when $F_{VR}>F_{HVT}$ and crank rod 64 resides between 280 and 10 degrees, Decrement left side stride height when $F_{VL}<F_{LVT}$ and crank rod 64 resides between 80 and 90 degrees, and Decrement right side stride height when $F_{VR}<F_{LVT}$ and crank rod 64 resides between 280 and 10 degrees.

Interface Circuit

Interface circuit 118 and computer 110 determine the "actual crank accelerations" $A_{A90}$ and $A_{E270}$ at crank rod 64 positions 90 and 270 by differentiating the VELOCITY signal and sampling the result whenever the POSITION signal indicates crank rod 64 is at either the 90 or 270 degree position. FIG. 13 depicts a circuit within interface circuit 118 for providing computer 110 with data V90, V270 representing rotational velocity at the 90 and 270 degree positions, data AA90 and AA270 representing actual acceleration at the 90 and 270 degree positions, and a data sequence V representing instantaneous rotational velocity. A digitizer 340 digitizes the VELOCITY signal many times during each rotational cycle in response to a CLOCK signal to produce the V data sequence. A differentiating amplifier 350 differentiates the VELOCITY signal and a digitizer 352 also clocked by the CLOCK signal, digitizes the result to produce another data sequence representing the angular crank acceleration A. Position detector 356 checks the POSITION signal on each pulse of the CLOCK, supplying an interrupt signal $INT_{90}$ to computer 110 whenever crank rod 64 is at the 90 degree position and supplying an interrupt signal $INT_{270}$ to computer 110 whenever crank rod 64 is at the 270 degree position. An OR gate 380 Ors the $INT_{90}$ and $INT_{270}$ signals to produce a signal for clocking a pair of registers 342 and 354 for storing the V and A outputs of digitizers 340 and 352, respectively. Interrupt signals $INT_{90}$ and $INT_{270}$ tell computer 110 to read the contents of registers 342 and 354. When $INT_{90}$ is asserted, computer 110 assumes the contents of registers 342 and 354 are $V_{90}$ and $A_{A90}$, and when $INT_{270}$ is asserted, computer 110 assumes the contents of registers 342 and 354 are $V_{270}$ and $A_{270}$. Since those of skill in the art will appreciate that there are many other possible ways to carry out the function of the circuit of FIG. 13 and that the approach used is a matter of design choice.

The difference between the expected and actual accelerations at the 90 and 270-degree positions of crank rod 64 is a function of the amount and direction of net horizontal force $F_H$ the user is applying to pins.

$$F_{H90}=m(A_{A90}-A_{E90})$$

$$F_{H270}=m(A_{A270}-A_{E270})$$

The constant m is the mass of the system the horizontal forces $F_{HR}$ and $F_{HL}$ must move when accelerating the crank at the 90 and 270-degree positions.

In the alternative embodiment of the invention, computer 110 determines $(A_{A90}-A_{E90})$ and $(A_{A270}-A_{E270})$ each time crank rod 64 arrives at it 90 or 270 degree position, and determines whether to increase or decrease stride length depending on the magnitude of the difference. When $(A_{A90}-A_{E90})$ or $(A_{A270}-A_{E270})$ is larger than a high threshold value, computer 110 increases both right and left side stride length. When $(A_{A90}-A_{E90})$ or $(A_{A270}-A_{E270})$ is less than a low threshold value, computer 110 decreases both right and left side stride length.

Referring to FIGS. 1 and 2, note that the user can also apply horizontal forces to crank rods 64 and 65 through linkages 22 and 23 by pushing and pulling on handle bars 40 and 41. Since in the alternative embodiment of the invention stride length is adjusted in response to horizontal forces on crank rod 64 regardless of whether they originate from user forces applied to pads 16 or 17 to hand grips 40 and 41, the user can increase or decrease stride length by increasing or decreasing forces he or she applies to hand grips 40 and 41 when crank rod 64 is at the 90 or 270 degree position.

Resistance Control

Referring to FIGS. 1, 7 and 8, control panel 24 includes a pair of pushbuttons 142 and 142 enabling the user to command computer 110 to increase or decrease the resistance to rotation of cranks 121 and 122 provided by regenerative brake 46 by signaling I/O interface circuit 118 to increase or decrease the resistance of resistor 128. Display devices 114 of FIG. 7 include a numeric display panel 143 for indicating the current resistance level.

Programmed Exercise

Computer 110 can operate in a "Program Mode" in which it automatically varies the resistance of brake 46, stride length, and/or stride height at various times during exercise. Referring to FIG. 8, the user presses either of a pair of pushbuttons 142 on control panel 24 to tell computer 110 whether it is to turn the program mode on or off.

Referring to FIGS. 7 and 8, display devices 114 and user input devices 112 within control panel 24 include in addition to control buttons and knobs 142 include a display monitor 141 for presenting data and other displays under control of computer 110. Display monitor 141 includes a conventional touchscreen for signaling computer 110 whenever the user has touched the surface of the display monitor and for indicating the area of the monitor the user has touched. Computer 110 displays push button icons and menu items the user can touch to provide input commands to computer 110. In the program mode, computer 110 generates a video of terrain on monitor 141 to simulate what the user might see if the user were running in such a terrain and also changes resistance, stride length, and/or stride height to simulate the effects of changes in the slope of the terrain viewed on display monitor 141. For example, resistance and stride height are increased and stride length is decreased when the display shows the user is traveling uphill while resistance and stride height are decreased and stride length is increased when the display shows the user is traveling downhill. Network adapter 116 suitably allows computer 110 to download various programs via the Internet in response to commands from the user via the touchscreen monitor 141. The user selects from among stored exercise programs listed as menu items on display monitor by using the touchscreen to select the appropriate menu item.

Computer 110 can use the touchscreen of monitor 141 to receive user input allowing the user, for example, to (a) Log in as a user or log out (b) Select exercise parameters being displayed.

(c) Select an exercise program, (d) Download a new exercise program.

Computer 110 also uses display monitor 141 to display a variety of data regarding user exercise in graphical or numeric form including, but not limited to:

(a) Current resistance level, (b) Elapsed exercise time, (c) Current speed of exercise, (d) Average speed of exercise, (e) Number of calories burned during exercise (f) Simulated distance traveled during exercise (g) Simulated elevation gains and losses during exercise, (h) User's weight, (j) Available exercise programs, (k) Currently selected exercise program, (l) Current stride height and length (m) Historical exercise data for each user.

Those of skill in the art will appreciate that computer 110 can be programmed to determine and display exercise speed, calories burned, distance traveled, and user weight from information provided by I/O interface 118 in response to signals it receives representing forces on the footpads, rotational velocity and position. Stride height, stride length and resistance are directly controlled by computer 110 and therefore known the computer. Historical exercise data for each user which may be displayed in tabular or graphical form, can include, for example, daily number of calories burned, distances traveled, exercise programs completed and times required to complete them.

The present invention has been described with the understanding that persons skilled in the art will recognize additional embodiments, improvements, and/or applications that nonetheless fall within the scope of the invention. For example, while the invention has been illustrated in connection with an elliptical exercise machine having a particular type of linkage for coupling each footpad to the frame and for controlling the path that the footpad follows, the invention in its broadest sense can be practiced in connection with exercise with any kind of linkage that can respond to input signals by adjusting one or more dimensions of that path. Therefore, the scope of the present invention as defined in any one the claims appended hereto is not intended to be limited to the particular linkage described in the specification and drawings except to the extent the claim recites details of such linkage. Also while the drawings and specification have described alternative methods and apparatuses for monitoring user forces on the footpad, including the use of strain gauges on the foot pad and processing the angular velocity signal to determine crank member acceleration, those of skill in the art will appreciate that the invention can be practiced using other methods and apparatuses for monitoring those forces. Therefore, the scope of the present invention as defined in any one of the claims appended hereto is not intended to be limited to any particular method of monitoring such forces described in the specification and drawings except to the extent that the claim may recite details of such method or apparatus. Those of skill in the art will also appreciate that any of a variety of methods and apparatuses for sensing the angular position of a rotatable member are known in the art and could be employed for that purpose when practicing the invention. Therefore, the scope of the present invention as recited in any one of the claims appended hereto is not intended to be limited to any particular method for sensing forces described in the specification and drawings except to the extent the claim may recite specific details of such method or apparatus. While the invention has been illustrated as being used in an elliptical exercise machine that guides a user's feet in an elliptical type of closed path, the principles of the invention can be used to automatically control path dimensions in other exercise machines such as, for example, steppers, gliders, skiers and climbers, that guide a user's feet in other types of closed paths including, for example, linear and/or arcuate paths that can be adjusted in one or more dimension.

The invention claimed is:

1. An exercise apparatus comprising:

a frame;

a footpad for supporting a user's foot;

a linkage for coupling the footpad to the frame and for guiding the footpad in a closed path in response to a force applied to the footpad by the user's foot, the linkage including a rotatable member having an angular position indicative of a position of the footpad within the closed path, wherein the linkage adjusts a dimension of the closed path in response to an electrical control signal supplied as input to the linkage; and a control system for monitoring the angular position of the rotatable member, for monitoring the force applied to the footpad, and for generating the control signal such that the linkage adjusts the dimension as a function of the monitored force on the footpad and of the angular position of the rotatable member, wherein the control system controls the control signal such that when a magnitude of the force is outside a magnitude range, the linkage alters the dimension while the angular position of the rotatable member is within a position range and otherwise refrains from adjusting the dimension.

2. The exercise apparatus in accordance with claim 1 wherein the control system generates the control signal to cause the linkage to increase and decrease the path dimension when it senses particular combinations the force and the angular position, thereby permitting the user to control the path dimension by controlling the force applied to the footpad.

3. The exercise apparatus in accordance with claim 1 further comprising:

a strain gauge coupled between the footpad and the linkage for generating a force indicating signal indicative of the magnitude of the force, wherein the control system monitors the force by monitoring the force indicating signal.

4. The exercise apparatus in accordance with claim 1 wherein the force and the dimension are in substantially parallel directions.

5. The exercise apparatus in accordance with claim 1 wherein the control system monitors the force by monitoring a rotational velocity of the rotatable member, and based on the monitored rotational velocity, determining a rotational acceleration of the rotatable member that is indicative of the magnitude of the force when the angular position of the rotatable member is within the position range.

6. The exercise apparatus in accordance with claim 1 wherein the dimension of the closed path defines a stride length of the user's foot.

7. The exercise apparatus in accordance with claim 1 wherein the dimension of the closed path defines a stride height of the user's foot.

8. The exercise apparatus in accordance with claim 1 wherein said footpad is a first footpad and the apparatus comprises a second footpad for supporting the user's other foot, the linkage couples the first and second footpads to the frame and guides the first and second footpads in closed paths in response to forces applied to the first and second footpads by the user's feet respectively, the linkage including a rotatable member having an angular position indicative of positions of the first and second footpads within their closed paths, wherein the linkage adjusts dimensions of the closed paths of the first and second footpads in response to electrical control signals supplied as inputs to the linkage, and the control system monitors the angular position of the rotatable member, for monitoring the forces applied to the first and second footpads, and for generating the control signals such that the linkage adjusts at least one dimension of the path of the first footpad as a function of monitored force on the first footpad and of the angular position of the rotatable member, and independently adjusts at least one dimension of the path of the second footpad as a function of monitored force on the second footpad and of the angular position of the rotatable member.

9. An exercise apparatus comprising a frame;

a footpad for supporting a user's foot;

a linkage for coupling the footpad to the frame and for guiding the footpad in a closed path in response to first and second forces applied in first and second directions, respectively, to the footpad by the user's foot, wherein the linkage includes a rotatable member having an angular position that changes with a position of the footpad within the closed path, and wherein the linkage adjusts first and second dimensions of the closed path in response to electrical control signals supplied as inputs to the linkage; and a control system for monitoring the angular position of the rotatable member, for monitoring magnitudes of first and second forces, and for generating the control signals such that the linkage adjusts the first and second dimensions as functions of the monitored first and second forces and of the monitored angular position of the rotatable member, wherein the control system controls the first control signal such that when a magnitude of the first force is outside a first magnitude range, the linkage alters the first dimension while the angular position of the rotatable member is within a first position range and otherwise refrains from altering the first dimension.

10. The exercise apparatus in accordance with claim 9 wherein the control signals cause the linkage to increase and decrease the path dimensions when it senses particular combinations of the angular position and first and second forces, thereby permitting the user to control the path dimensions by controlling the force applied to the footpad.

11. The exercise apparatus in accordance with claim 9 wherein the control system controls the first and second control signals such that when a magnitude of the second force is outside a second magnitude range, the linkage alters the second dimension while the angular position of the rotatable member is within a second position range and otherwise refrains from adjusting the second dimension.

12. The exercise apparatus in accordance with claim 9 further comprising:

a first strain gauge coupled between the footpad and the linkage for generating a first force indicating signal indicative of the magnitude of the first force, and a second strain gauge coupled between the footpad and the linkage for generating a second force indicating signal indicative of the magnitude of the second force, wherein the control system monitors the first and second forces by monitoring the first and second force indicating signals.

13. The exercise apparatus in accordance with claim 9 wherein the first dimension of the closed path defines a stride length of the user's foot, and wherein the second dimension of the closed path defines a stride height of the user's foot.

14. A method for controlling an exercise apparatus having a frame, a footpad for supporting a user's foot, and a linkage for coupling the footpad to the frame and for guiding the footpad in a closed path in response to a force applied to the footpad by the user's foot, wherein the linkage includes a rotatable member having an angular position that changes with a position of the footpad within the closed path, and wherein the linkage adjusts a dimension of the closed path in response to an electrical control signal supplied as input to the linkage, the method comprising the steps of a. monitoring the angular position of the rotatable member, b. monitoring a magnitude of the force, and c. controlling the control signal such that the linkage adjusts the dimension as a function of the monitored force on the footpad and of the monitored angular position of the rotatable member, wherein step c comprises controlling the control signal such that when a magnitude of the force is outside a magnitude range, the linkage alters the dimension while the angular position of the rotatable member is within a position range and otherwise refrains from adjusting the dimension.

15. The method in accordance with claim 14 wherein the control signals cause the linkage to increase and decrease the path dimension when it senses particular combinations of the monitored angular position and the monitored force, thereby permitting the user to control the path dimension by controlling the force applied to the footpad.

16. The method in accordance with claim 14 wherein the exercise apparatus includes a strain gauge coupled between the footpad and the linkage for generating a force indicating signal indicative of the magnitude of the force, and wherein step b comprises monitoring the force indicating signal.

17. The method in accordance with claim 14 wherein the force and the dimension are in substantially parallel directions.

18. The method in accordance with claim 14 wherein step b comprises the substeps of:

b1. monitoring a rotational velocity of the rotatable member, and b2. based on the monitored rotational velocity, determining a rotational acceleration of the rotatable member indicative of the magnitude of the force when the angular position of the rotatable member is within the position range.

19. The exercise apparatus in accordance with claim 14 wherein the dimension of the closed path defines a stride length of the user's foot.

20. The method in accordance with claim 14 wherein the dimension of the closed path defines a stride height of the user's foot.

21. The method in accordance with claim 14 wherein said footpad is a first footpad and the exercise apparatus comprises a second footpad for supporting the user's other foot, the linkage couples the first and second footpads to the frame and guides the first and second footpads in closed paths in response to forces applied to the first and second footpads by the user's feet respectively, the linkage including a rotatable member having an angular position indicative of positions of the first and second footpads within their closed paths, wherein the linkage adjusts dimensions of the closed paths of the first and second footpads in response to electrical control signals supplied as inputs to the linkage, step b. comprises monitoring the forces applied to the first and second footpads, and step c. comprises controlling the control signals such that the linkage adjusts at least one dimension of the path of the right footpad as a function of monitored force on the right footpad and of the angular position of the rotatable member, and independently adjusts at least one dimension of the path of the left foot pad as a function of monitored force on the left footpad and of the angular position of the rotatable member.

22. A method for controlling an exercise apparatus having a frame, a footpad for supporting a user's foot, and a linkage for coupling the footpad to the frame and for guiding the footpad in a closed path in response to first and second forces applied in differing directions to the footpad by the user's foot, wherein the linkage includes a rotatable member having an angular position that changes with a position of the footpad within the closed path, and wherein the linkage adjusts first and second dimensions of the closed path in response to a plurality of electrical control signals supplied as inputs to the linkage, the method comprising the steps of a. monitoring the angular position of the rotatable member, b. monitoring magnitudes of first and second forces, and c. controlling the control signals such that the linkage adjusts the first and second dimensions as functions of the monitored first and second forces and the monitored angular position of the rotatable member, and wherein step c comprises controlling the first control signal such that when a magnitude of the first force is outside a first magnitude range, the linkage alters the first dimension while the angular position of the rotatable member is within a first position range and otherwise refrains from adjusting the first dimension.

23. The method in accordance with claim 22 wherein the control signals cause the linkage to increase and decrease the path dimensions when it senses particular combinations of the monitored angular position and first and second forces, thereby permitting the user to control the path dimensions by controlling the force applied to the footpad.

24. The method in accordance with claim 22 wherein the exercise apparatus includes a first strain gauge coupled between the footpad and the linkage for generating a first force indicating signal indicative of the magnitude of the first force, wherein the exercise apparatus includes a second strain gauge coupled between the footpad and the linkage for generating a second force indicating signal indicative of the magnitude of the second force, and wherein step b comprises monitoring the first and second force indicating signals.

25. The method in accordance with claim 22 wherein step c comprises controlling the first and second control signals such that when a magnitude of the second force is outside a second magnitude range, the linkage alters the second dimension while the angular position of the rotatable member is within a second position range and otherwise refrains from adjusting the second dimension.

26. The method in accordance with claim 22 wherein the first and second forces are applied to the footpad in substantially orthogonal directions.

27. The method in accordance with claim 22 wherein the first and second dimensions are in substantially orthogonal directions.

28. The method in accordance with claim 22 wherein the first dimension of the closed path defines a stride length of the user's foot, and wherein the second dimension of the closed path defines a stride height of the user's foot.

29. An exercise apparatus comprising:

a frame, a right footpad for supporting a user's right foot, a left footpad for supporting the user's left foot, a linkage for coupling the right and left footpads to the frame and for guiding the right and left footpads in closed paths in response to forces applied to the right and left footpads by the user's right and left feet, the linkage including a rotatable member having an angular position indicative of positions of the right and left footpads within their closed paths, wherein the linkage adjusts dimensions of the closed paths of the right and left footpads in response to electrical control signals supplied as inputs to the linkage, and a control system for monitoring the angular position of the rotatable member, for monitoring the forces applied to the right and left footpads, and for generating the control signals such that the linkage adjusts at least one dimension of the path of the right footpad as a function of monitored force on the right footpad and of the angular position of the rotatable member, and independently adjusts at least one dimension of the path of the left foot pad as a function of monitored force on the left footpad and of the angular position of the rotatable member, and wherein the control system controls the control signals such that when a magnitude of the force on the right footpad is outside a first magnitude range, the linkage alters the dimension of the closed path of the right footpad while the angular position of the rotatable member is within a first position range and otherwise refrains from adjusting the dimension of the closed path of the right footpad.

30. The exercise apparatus in accordance with claim 29 wherein the control system generates the control signals to cause the linkage to increase and decrease the path dimensions of the right and left footpads when it senses particular combinations the angular position and the monitored forces, thereby permitting the user to independently control the dimensions of the paths followed by the right and left footpads by controlling the forces applied to the right and left footpads.

31. The exercise apparatus in accordance with claim 30 wherein the control system controls the control signals such that when a magnitude of the force on the left footpad is outside a second magnitude range, the linkage alters the dimension of the closed path of the left footpad while the angular position of the rotatable member is within a second position range and otherwise refrains from adjusting the dimension of the closed path of the left footpad.

32. A method for controlling an exercise apparatus having a frame, a right footpad for supporting a user's right foot, a left footpad for supporting the user's left foot, and a linkage for coupling the right and left footpads to the frame and for guiding the right and left footpads in closed paths in response to forces applied to the right and left footpads by the user's right and left feet, the linkage including a rotatable member having an angular position indicative of positions of the right and left footpads within their closed paths, wherein the linkage adjusts dimensions of the closed paths of the right and left footpads in response to electrical control signals supplied as inputs to the linkage, the method comprising the steps of a. monitoring the angular position of the rotatable member, b. monitoring the forces applied to the right and left footpads, and c. generating the control signals such that the linkage adjusts at least one dimension of the path of the right footpad as a function of monitored force on the right footpad and of the angular position of the rotatable member, and independently adjusts at least one dimension of the path of the left foot pad as a function of monitored force on the left footpad and of the angular position of the rotatable member, and wherein step c comprises generating the control signals such that the control signals cause the linkage to alter the dimension of the closed path of a first of the right and left footpads when a magnitude of the force on the first of the right and left footpads is outside a first magnitude range while the angular position of the rotatable member is within a first position range and otherwise to refrain from adjusting the dimension of the closed path of the first of the right and left footpads.

33. The method in accordance with claim 32 wherein the control signals cause the linkage to increase and decrease the path dimensions of the right and left footpads when in response to particular combinations of the angular position and the monitored forces, thereby permitting the user to independently control the dimensions of the paths followed by the right and left footpads by controlling the forces applied to the right and left footpads.

34. The method in accordance with claim 33 wherein step c comprises generating the control signals such that the control signals cause the linkage to alter the dimension of the closed path of the second of the right and left footpads when a magnitude of the force on the second of the right and left footpads is outside a second magnitude range while the angular position of the rotatable member is within a second position range and otherwise to refrain from adjusting the dimension of the closed path of the second of the right and left footpads.

* * * * *